US007305788B1

(12) United States Patent
McLain

(10) Patent No.: US 7,305,788 B1
(45) Date of Patent: Dec. 11, 2007

(54) BATTERING RAM WITH EXPLOSIVE DISCHARGE

(76) Inventor: John McLain, 8530 Vintage Woods Dr., Mobile, AL (US) 36619

( * ) Notice: Subject to any disclaimer, the term of this patent is extended or adjusted under 35 U.S.C. 154(b) by 0 days.

(21) Appl. No.: 11/391,091

(22) Filed: Mar. 28, 2006

Related U.S. Application Data

(60) Provisional application No. 60/676,143, filed on Apr. 29, 2005.

(51) Int. Cl.
*F41C 9/00* (2006.01)

(52) U.S. Cl. ..... 42/1.08; 42/90; 42/105

(58) Field of Classification Search ..... 42/105, 42/79, 90, 1.08; 89/90, 1.34, 1.14
See application file for complete search history.

(56) References Cited

U.S. PATENT DOCUMENTS 2,558,200 A * 6/1951 Schmeling ..... 42/79
3,163,953 A * 1/1965 Bridge, Sr. ..... 42/79
3,744,370 A * 7/1973 Snodgrass ..... 89/14.5
3,879,878 A * 4/1975 Musgrave ..... 42/90
5,092,223 A * 3/1992 Hudson ..... 89/14.2
5,325,758 A * 7/1994 Compton et al. ..... 89/14.5
5,685,102 A * 11/1997 Latka ..... 42/85
5,811,713 A * 9/1998 Gudgel ..... 89/1.34
6,026,728 A * 2/2000 Guhring et al. ..... 89/14.5
6,276,085 B1 * 8/2001 Wooten et al. ..... 42/1.08
6,318,228 B1 * 11/2001 Thompson ..... 89/1.14
6,732,463 B2 * 5/2004 Dixon et al. ..... 42/1.08
6,789,343 B1 * 9/2004 Dietrich et al. ..... 42/79
6,860,052 B1 * 3/2005 Conner et al. ..... 42/1.08
6,889,593 B2 * 5/2005 Guhring et al. ..... 89/14.5
6,973,863 B1 * 12/2005 Jones ..... 89/14.2
2002/0179307 A1 * 12/2002 Schmidt et al. ..... 169/70
2004/0035040 A1 * 2/2004 Dixon et al. ..... 42/1.08

* cited by examiner

*Primary Examiner*—Michael J. Carone
*Assistant Examiner*—Benjamin P. Lee

(57) ABSTRACT

A noise generation device is taught which is used in conjunction with a shotgun generating a blast which has a) at least one chamber for receiving the blast from the barrel; b) a connecting bolts for joining the one chamber to the barrel; c) at least one exhaust port for venting the blast from the barrel; d) a channeling ramp for directing the blast towards the vent, and a blade and drive for pushing the device through a wall. It also includes various noise and blast generators which may be used to supplement the initial blast.

6 Claims, 16 Drawing Sheets

BATTERING RAM WITH EXPLOSIVE DISCHARGE

PRIORITY

The patent claims priority based on provisional patent No. 60/676,143 filed Apr. 29, 2005.

BACKGROUND OF THE INVENTION

1. Field of Invention

The invention relates to concussion and distraction devices.

2. Prior Art

Concussion grenades are known in the prior art. Incendiary shells with and without powder payloads are known.

GENERAL DISCUSSION OF THE INVENTION

The invention uses a modification of an existing weapon (such as a shot gun) or a new weapon specifically designed with a blast capability to create a new device for inserting the blast through a wall, window or other surface.

The primary purpose of the gun is to provide for a mechanism by which a controlled incendiary, or non incendiary (air driven, water driven etc.) device may provide at least one directional blast utilizing a mechanism or penetrating means which can be introduced into a partially sealed environment such as a room with a window.

The primary parts of the invention include a charge generating means, which in the preferred embodiment is a shot gun 18, having either blank shells or shells filled with tear gas or related irritants or smoke; an extension means including a sleeve 5 fitting over the barrel 3 for attaching a barrel extension 4 to the barrel 3 of the shot gun 18 and a directional means for changing the direction of the blast.

The blast generator and extension in the preferred embodiment involves a special barrel attachment with a securing means composed of threaded bolts running threaded holes through the barrel attachment walls into the existing barrel which preferably is partially threaded or grooved to receive the threaded bolt. The extension defines a blast chamber 8 ending at a ramp 10 for directing the blast continuous with the shot gun barrel 3. The chamber 8 preferably ends in a slanted ramp 10 terminating at or near one or more ports 9 in order to directionally shift the blast to the port 9 in one or more than one desired direction. Preferably the desired direction is downward to prevent injury resulting from the blast. The direction can shift from downward to upward as conditions change (as with before and after entry by a friendly force). Likewise, there is a directional indicator which is preferably the gun layout to identify to the user the direction in which the blast is being directed for allowing the blast to be safely or properly directed.

There is also an alignment mechanism in the preferred embodiment which in this case is a locking connection between gun barrel of the gun and the extension so that the direction of the explosion is in a given direction which is preferably upward or downward depending on the proximity to the floor or ceiling in order to minimize the possibility of injury.

There may be an igniting cover means which covers completely or partially one or more of the ports 9 which cover means is ignitable or fragmentary by the initial blast in order to provide a flash, projectile, powder or gas discharge and/or an additional blasting noise when the first blast is ignited which can be described as a flash type explosive, a bang or noise generating type explosive, or a projectile generating explosive which is attachable to the end of the rifle and at the exit in a way to be ignitable in response to the shot gun blast so as to initiate an additional distraction. Alternatively there may be a projectile means over or within the opening designed to distribute one or more projectiles (such as rubber balls) in response to the pressure from the explosion.

The projectiles may be lethal or non lethal in accordance with the various embodiments which are taught herein.

At the head of the device is a penetrating means which in the preferred embodiment is a pointed blade 15 which allows the device to be driven through a window, wall or door. This blade may extend past the edges of the end to help keep the port open as it is driven through the surface.

In order to prevent the device from being extended further than desired and in order to give a surface for ramming the device through thick walls, one or opposing stops or a surrounding stop may be used. There may be at least one first stop to stop the device from moving forward and at least one pressure plate behind the stop which can be held or kicked to push the device into place and these may be adjustably connected to the extension in order to provide that the length of penetration may be adapted for various uses, such as thick walls or thin walls.

In one embodiment, rather than having a single exit port 9, there is a double port which may either have side by side ports or top and bottom or left and right exit ports 9. Any ports may be separated into multiple openings.

In one embodiment, the blast would come out of a common chamber and in an alternate embodiment it would come out of two or more chambers such as double barrel or three barreled shot gun generating the blast in question.

A single barrel gun, semi automatic or pump, is usually adequate in order to provide a sufficient amount of noise. In other embodiments it may be preferable to have multiple barrels or chambers generating blasts together or in succession in order to have a louder or a more constant noise.

In the preferred embodiment, some delay between the blasts is believed to be beneficial. To allow for this, the weapon can be automatic, semi-automatic or pump. A pump action works particularly well because of the noise generated by the pumping action.

In the primary embodiment, the end of the gun channels the blast in an alternate direction. The blade 15 or the entire direction channeling end may detach after it is used as a battering ram in certain embodiments.

Elements such as barbs 37 may be used to lock the device in place so it cannot be easily pushed out after insertion.

It is therefore one purpose of the invention to provide a mechanism for providing a distracting noise in an invasion situation.

It is a further purpose of the invention to provide a distracting mechanism which generates a blast of noise and sound in a predetermined direction.

It is a further purpose of the invention to provide a noise and a distracting mechanism capable of penetrating an enclosed or partially enclosed environment and generating a direct blast of noise sound, smoke, and lethal or nonlethal projectiles in one or more specific directions.

It is a further object of the device to provide a weapon for entering into a closed area and providing a distraction utilizing sound, light, and debris and preferably in a nonlethal manner in the preferred embodiments, but in a potentially lethal manner in alternate embodiments.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
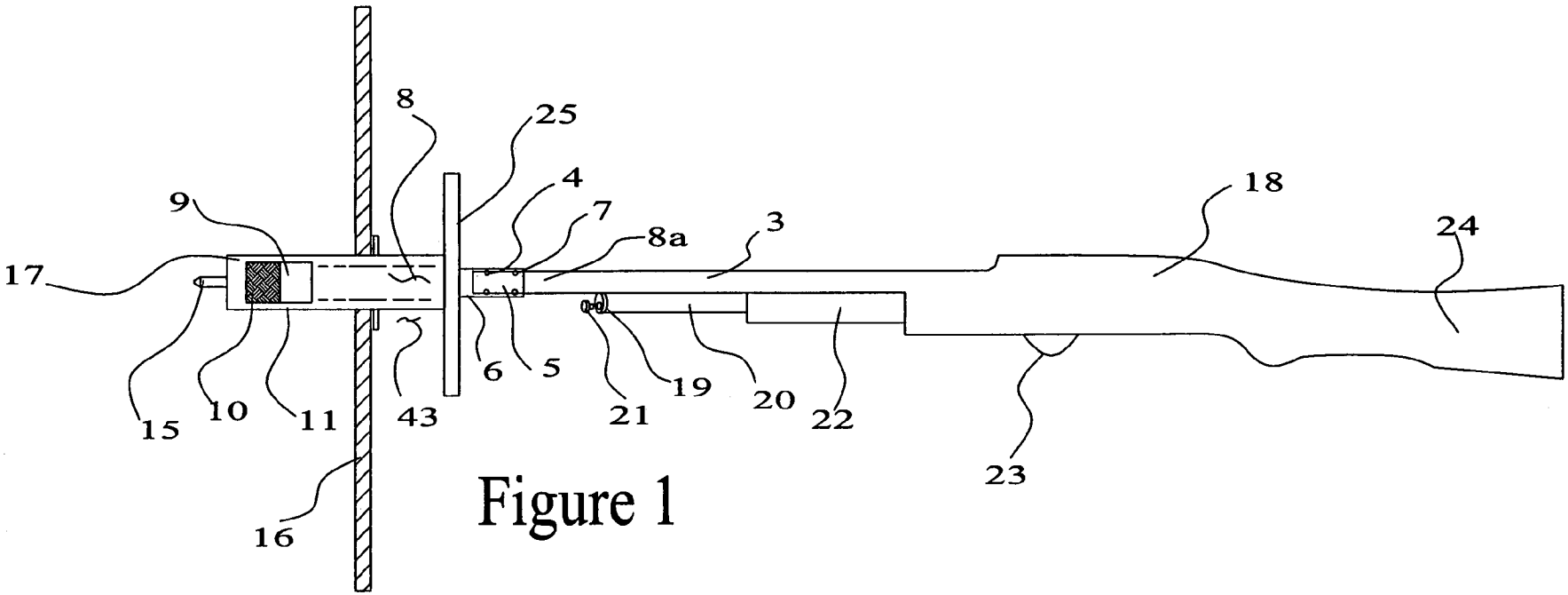
FIG. 1 shows the device installed on a shot gun.

As can best be seen by reference to FIG. 1, the invention is a distraction device which consists of a gun 18 (preferably a shot gun) which has a gun barrel 3 and attaches by way of one connecting means, here a sleeve 5 and securing posts 6 passing through the sleeves 5 and into receiving indentations 7 in the barrel 3, said receiving indentations 7 being designed to receive the securing posts 6 which are threaded to screw through sleeve 5.

The sleeve 5 defines an inner chamber 8 having an inner chamber opening 8*a* designed to fit over the gun barrel 3. The inner diameter of chamber 8 and outer diameter of barrel 3 are approximately the same to ensure a tight fit in the preferred embodiment. In other embodiments, cushioning or a washer may be in place between the extension and extension and barrel The barrel extension is a channeling means which extends the chamber past the end of the barrel 3 to the port 9.

Figure 2:
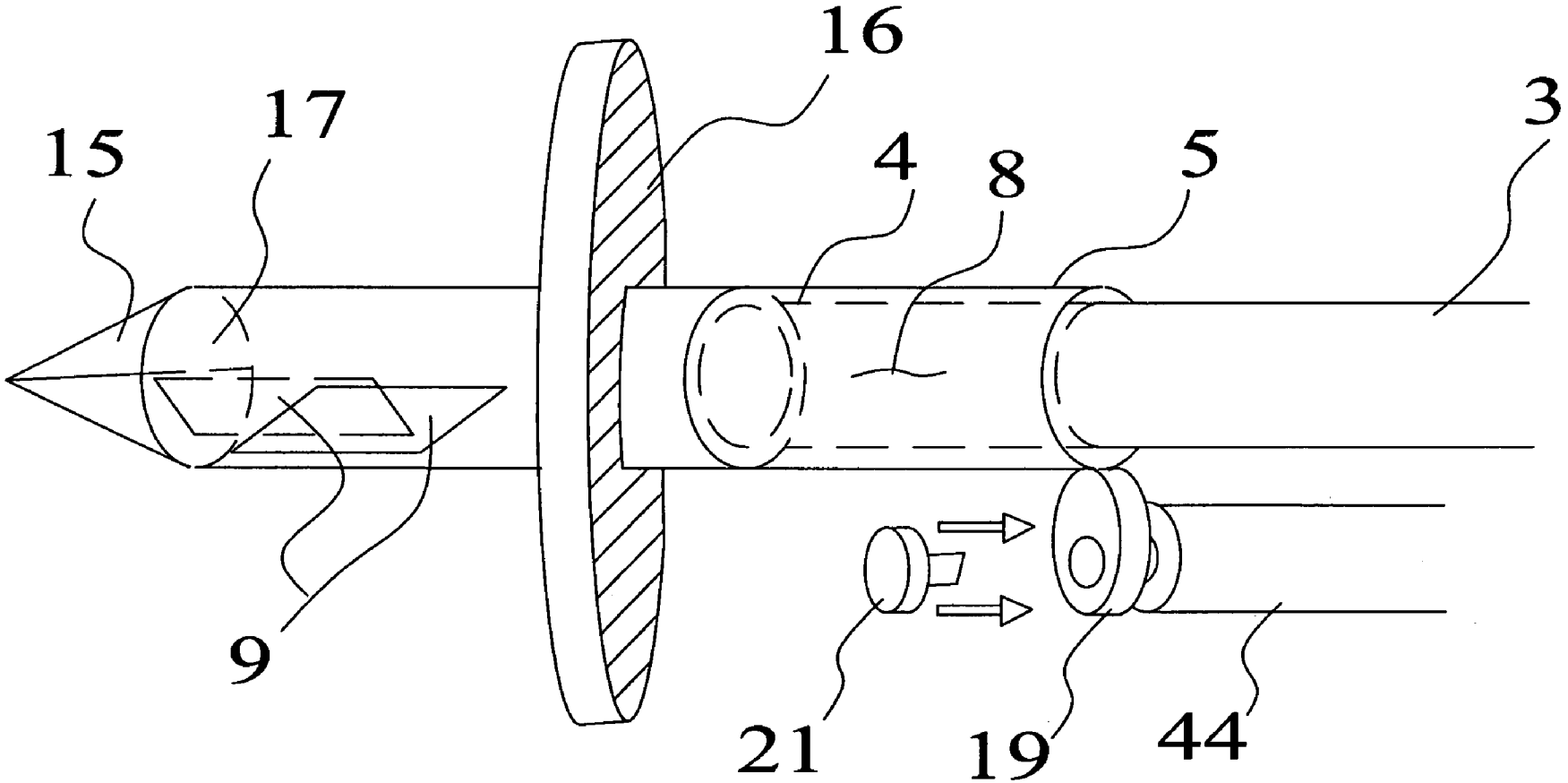
FIG. 2 shows a first alternate embodiment having two angled openings.

There is at least one exit opening port 9 and, in an alternate embodiment, a plurality of exit openings ports 9, in the extension 4. For this purpose, the extension 4 may be square shaped as shown in FIG. 1 or round as shown in FIG. 2 and may be color coded on one side to show the side with the exit opening (ports 9) or the side opposite the exit opening so that the user is assured of the direction in which the opening or ports 9 are pointed. The extension 4 is thickened to reinforce the barrel and so that the explosion can be redirected. A weak point (not shown) may be used to direct a barrel failure in a specific direction.

There is an angle director means, comprised in part of a ramp 10 at the end 17 of the barrel extension chamber 8 to direct the blast from the gun outward at the desired angle and in order to lessen the impact on the end 17.

There are securing walls or railings 11 on either side of the exit ports 9 to secure the end 16 to the extension 4. In some embodiments, the end 17 may slide off of these railings 11 (FIG. 12) so that the chamber 8 is expose without the ramp 10 after the end 17 penetrates a wall and/or after the first blast is fired with gas or powder shells. This would allow gas or projectiles to be disbursed more directly within the room.

The shells used may be blank shells and may be automatically fed at a desired rate or may be pumped into place and fired according to any other mechanism known in the prior art. Some or all the shells may be chemically driven (as with gun powder) and may include a tear gas or anti-personnel gas or powder of the type known in the prior art.

There is also a penetrating blade 15 attached to the end 17 of the extension 4 in order to allow the extension 4 to be driven directly through a wall.

There is an optional stop 16 which is designed as stop means in the shape of a plate or bar and is of such size and width to prevent or inhibit the penetration of the device past the stop 16 and also provide a surface for pushing the extension 4 through a wall where desired. A second pressure plate 25 serves as a gripping means or pushing the device through the wall separated from the stop 16 by a space 43 and attached by a spacer 28 (FIG. 7) may be provided to allow the user to stay out of contact with the wall as the stop 16 contacts the wall 30 through which the device is driven.

FIG. 2 shows where the extension 4 is tubular in shape in order to take advantage of the strength this shape adds. This also shows two downward facing, angled exit ports 9 near the end 17 or the extension. Also the blade 15 may have a cone shape which goes to the edges of the end 17 in this embodiment. In other embodiments, such as FIG. 11, it may be desirable to have this blade 15 extend beyond the perimeter of the end 17.

In FIG. 2, the stop 1 is shown as a disk around the extension 4. Also shown is the screw 21 going through a ring 19 attached to the bottom of the extension and into the front of the pump slide 44 to secure the direction of the blast downward and to further secure the sleeve 5 onto the gun barrel 3.

Figure 3:
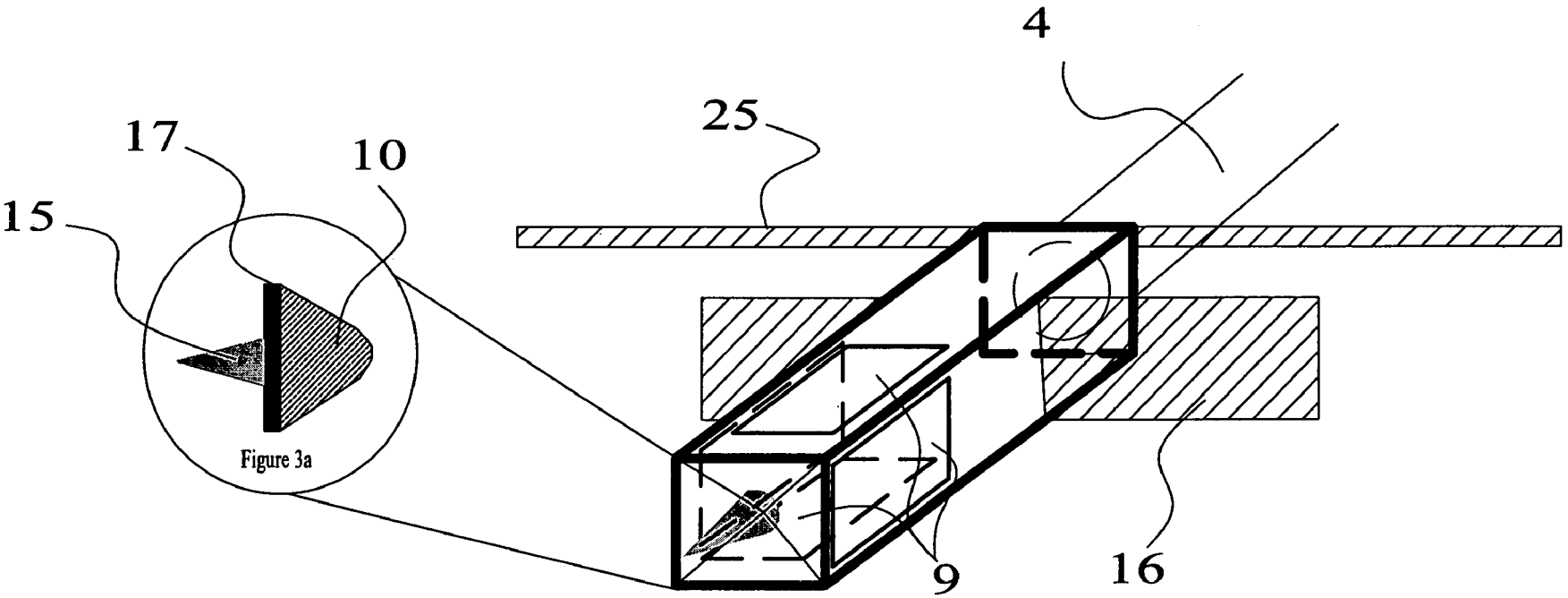
FIG. 3 shows a second alternate embodiment showing four openings.

As shown in FIG. 3, where there are multiple openings 9, here four separated by 90 degrees, the angle director ramp 10 may be shaped as a pyramid or cone so the blast is angled away from the end 17 and attached to the end 17. In this version, the director ramp 10 is attached to the rear of the end 17 and the blade 15 is attached to the front of the end 17. Also in FIG. 3, the device is made as a single unit continuous with and a part of the gun barrel 3 so that items 4 and 3 are molded from a single part for strength. They may be welded together to get this effect. A detail FIG. 3*a* shows how a cross section through the center of the ramp 10, blade 15 & end 17 would appear.

Figure 3A:
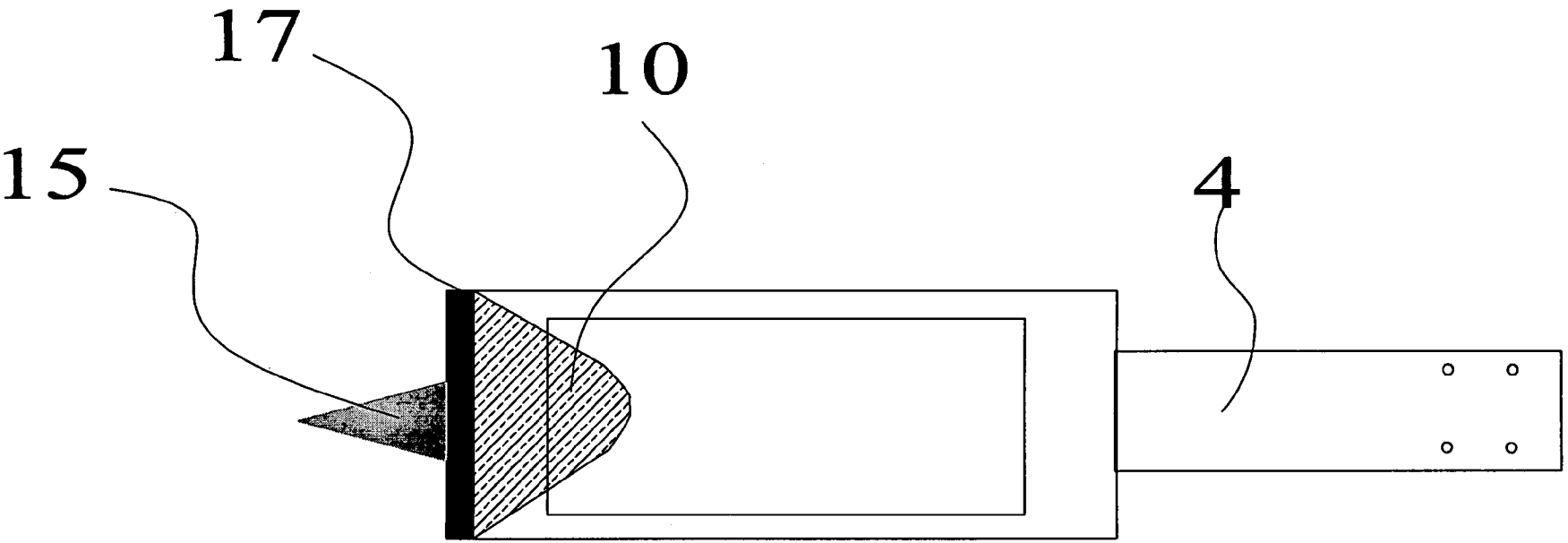

FIG. 3*a* shows a detail of FIG. 3 and cross section.

Figure 4:
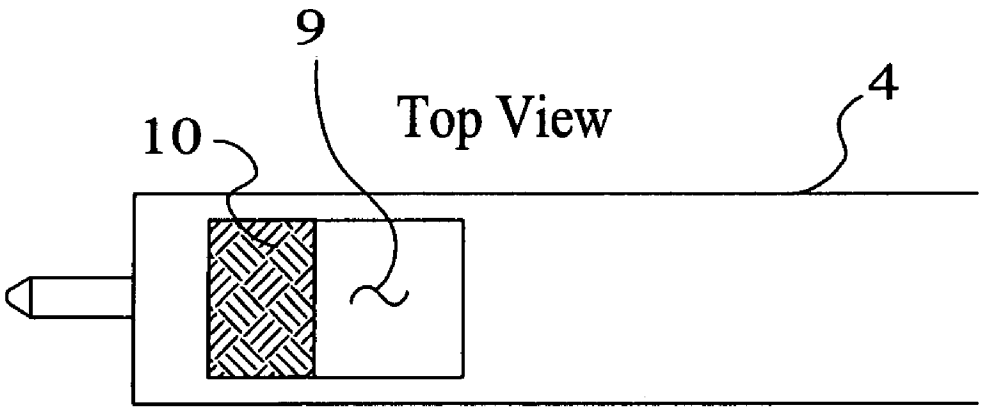
FIG. 4 shows a cross section of the bottom view looking upward in the preferred embodiment.

FIG. 4 shows a bottom view looking upward into a single openings 9 in the extension 4 showing the ramp 10 starting between the front 31 and rear 32 of the openings.

Figure 5:
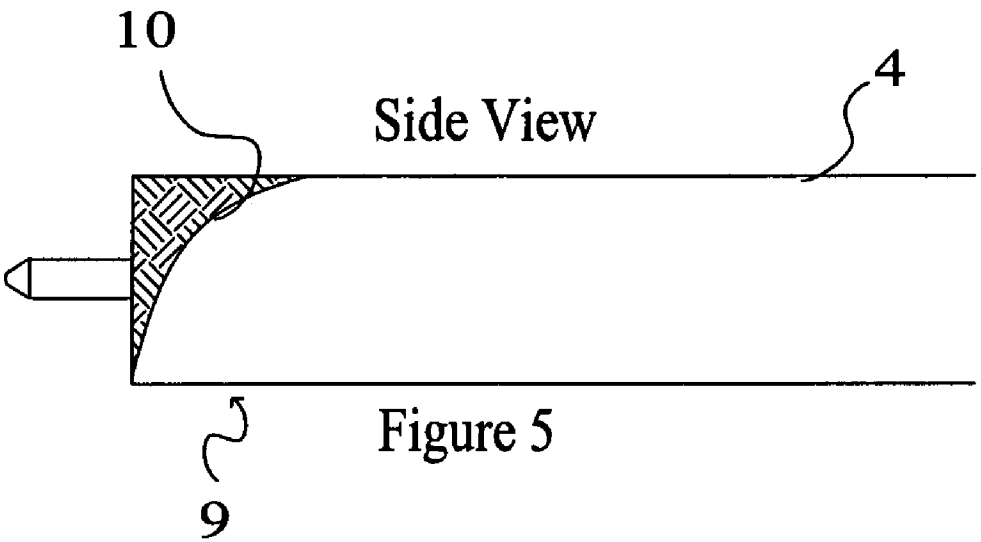
FIG. 5 shows a cross sectional side view of the version shown in FIG. 4.

FIG. 5 shows a cross sectional side view of the embodiment shown in FIG. 4 showing the ramp 10 as a solid piece, essentially continuous with the end 17.

Figure 6:
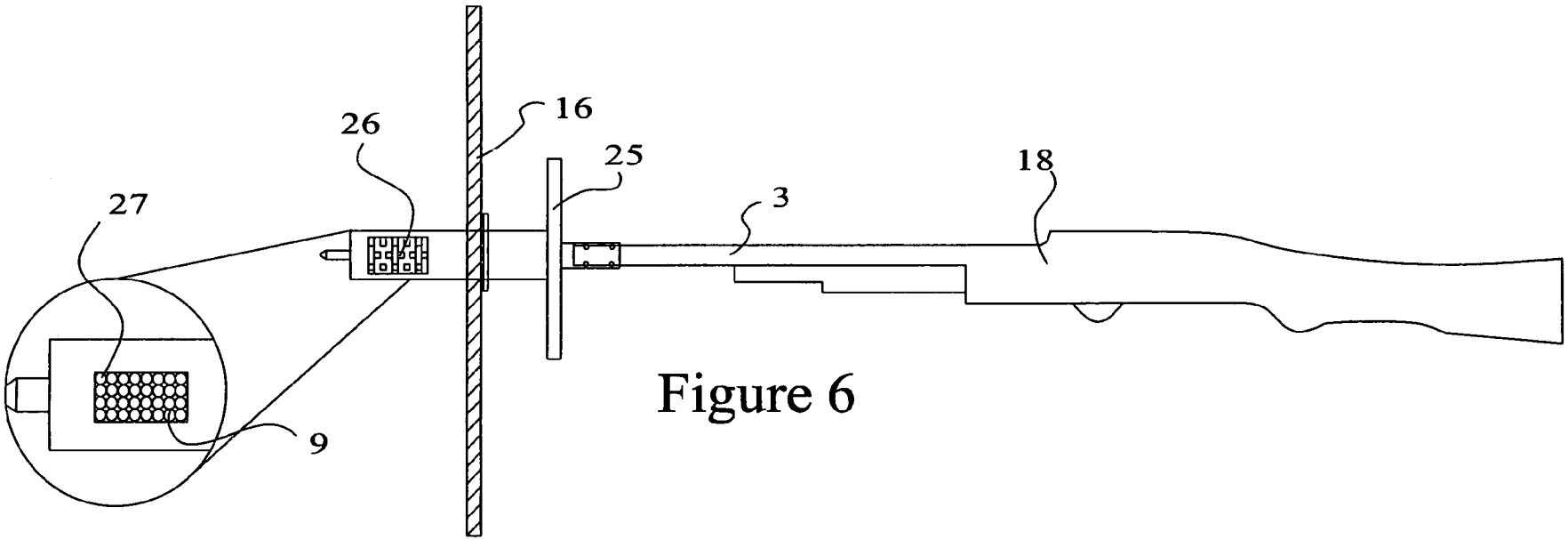
FIG. 6 shows the embodiment of FIG. 1 with an added explosive distribution face.

FIG. 6 shows an alternate embodiment with an explosive distribution face 26 as an auxiliary means over at least part of opening 9. This face 26 may be equipped with powder or gas distributing pellets 27 or the pellets 27 may be rubber or metal shot which goes at least partially over the exit opening 9 and is subsequently ejected as an auxiliary means in order to provide a further distraction and in the case of pellets 27, these pellets may also be designed in such a way as to generate a report as by being contact explosive type pellets of the type known in the art or may be rubber balls or even made of a harder material depending on the use to which the device is put and the amount of the distraction which is determined necessary.

In addition, the pellets may be connected with material or replaced with a material which is ignited by the blast from the gun explosively or otherwise in order to provide an additional distraction or to import additional force to the pellets.

Figure 7:
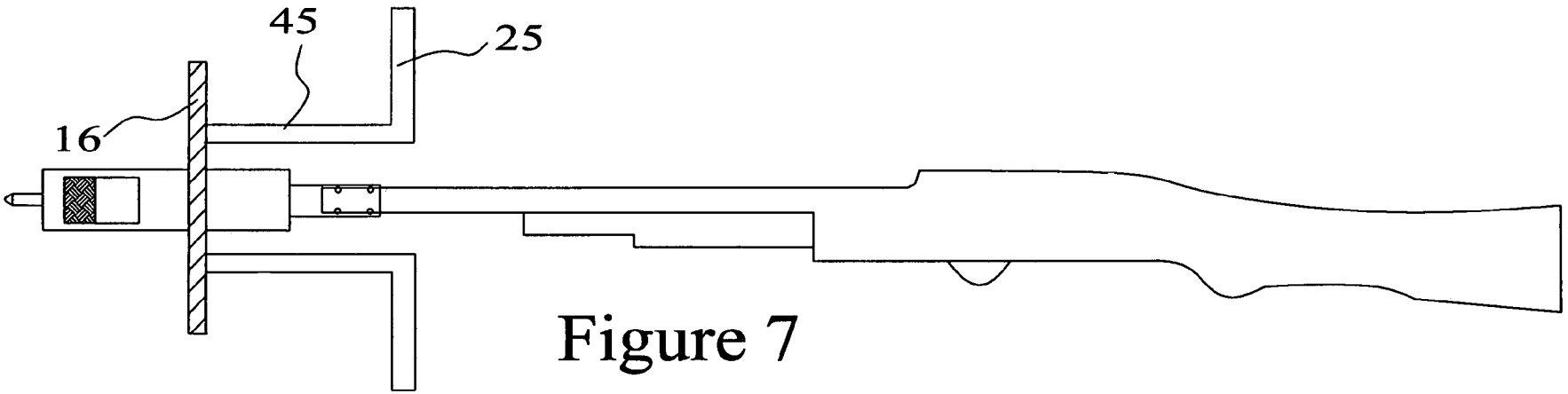
FIG. 7 shows an alternate embodiment designed to be forced through thicker walls.
Figure 15:
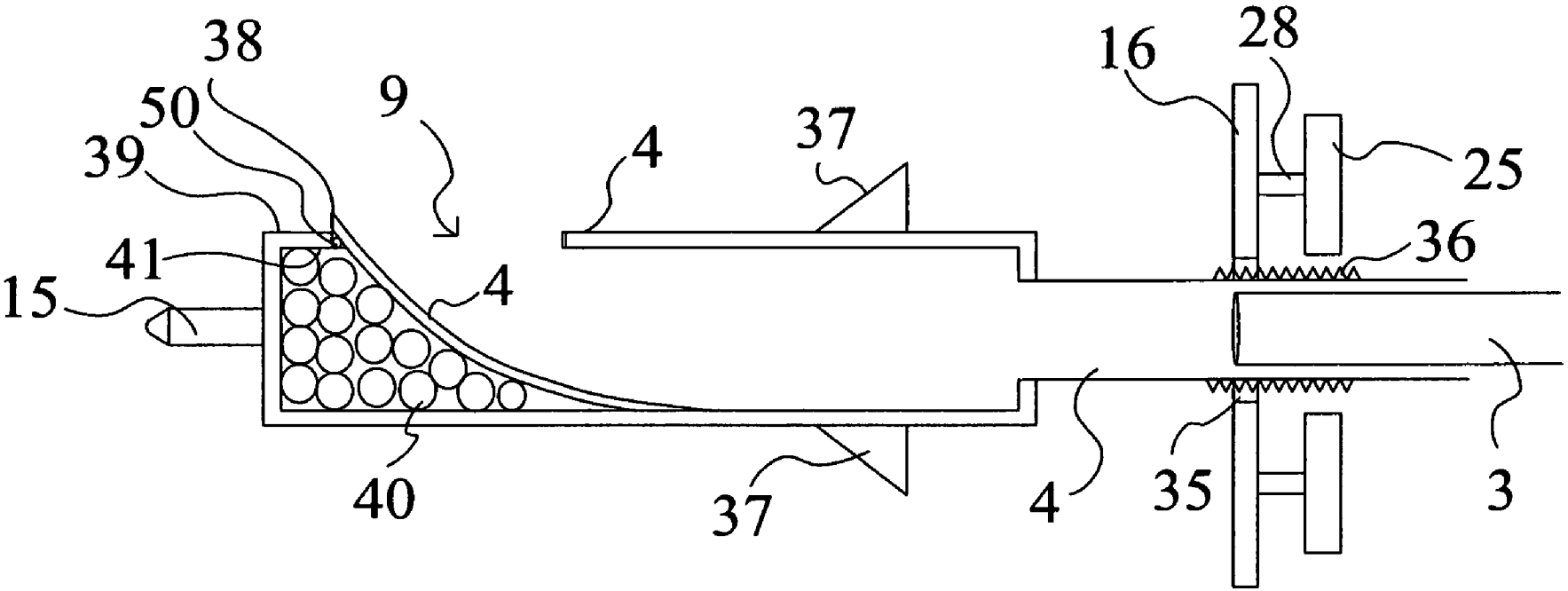
FIG. 15 shows a modification of the embodiment shown in FIG. 1 wherein barbs are used, a moveable ramp and a variably placed stop.
Figure 16:
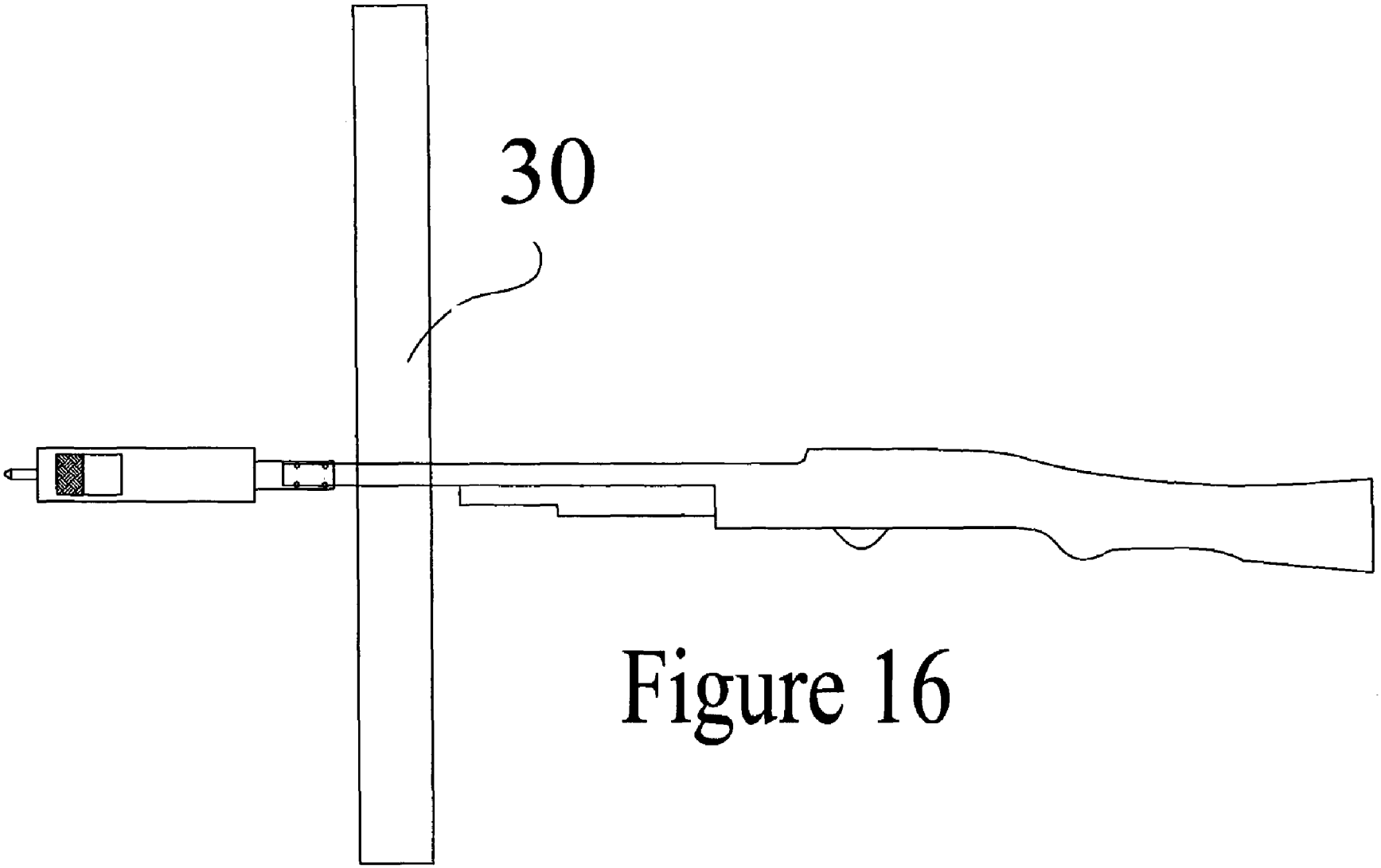
FIG. 16 shows the embodiment of FIG. 1 inserted through a wall.

FIG. 7 shows an alternate embodiment designed to be forced through thicker walls 30. In this embodiment, the pressure plate 25 is attached to the rear of the stop 16 by arms 45 so that users on either side or above and below the barrel 3 may push against plate 25 to drive the device through a wall (FIG. 15)

The use of the invention involves the steps of (1) selecting a location for penetrating a surface into a partially enclosed environment where entry into the enclosed environment is desired;

Penetrating the wall in question with the extension;

Causing through the penetrating area a directional blast at a predetermined point based on the application of varying levels of incursion;

Proximately in time (or simultaneously) with the step of penetration, creating a distraction with or without the use of projectiles, gases, powders or a combination of the above.

It can be seen that with embodiments that have an explosive projectile at the end of the weapon, the users may insert projectiles, gasses or powder and thereafter, maintain firing with an absence of projectiles (other than those which may be added to the shotgun shells) using sound and nonlethal force so that the initial application of force is followed by a pure distraction from the direction of the projectile type force in order to maintain the tension of individuals within the enclosed environment.

In this embodiment, the pressure plate may be in front of or extend behind the gun trigger so that one or more individuals can act as force behind pushing the device through a wall while a user operates the shot gun trigger. The stop also provides protection by sealing the opening.

In other embodiments, the extension may be adequately supported so that with the users holding it, it may be used to jack itself through the wall against which is being used.

In such a situation, the stop may be used as an indicator in order to indicate when the smaller part is broken through the wall so that it may then be held in place and also to prevent someone on the other end from pulling the device through. The stop may be larger to shield the user from the blast.

A single exhaust port (exit) blast channel with penetrating blade and an angled projectile director are the elements of the most simple embodiment.

Figure 8:
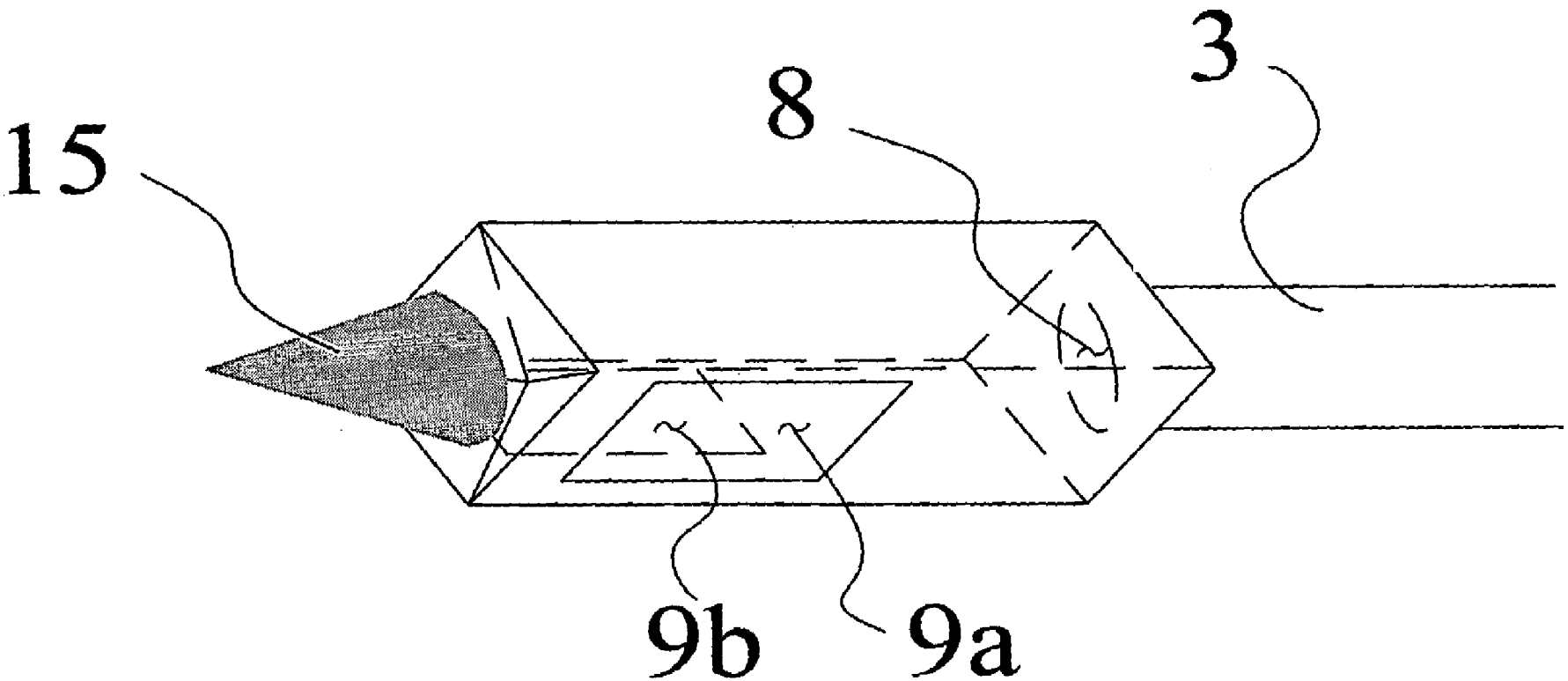
FIG. 8 shows an embodiment where the barrel extension has dual exhaust ports or exit openings from the blast channel with a penetrating cone and a pyramid shaped projectile director ramp.

FIG. 8 shows an embodiment where the barrel extension has dual exhaust ports or exit openings from the blast channel with a penetrating cone and a pyramid shaped projectile director attached to the end.

Figure 9:
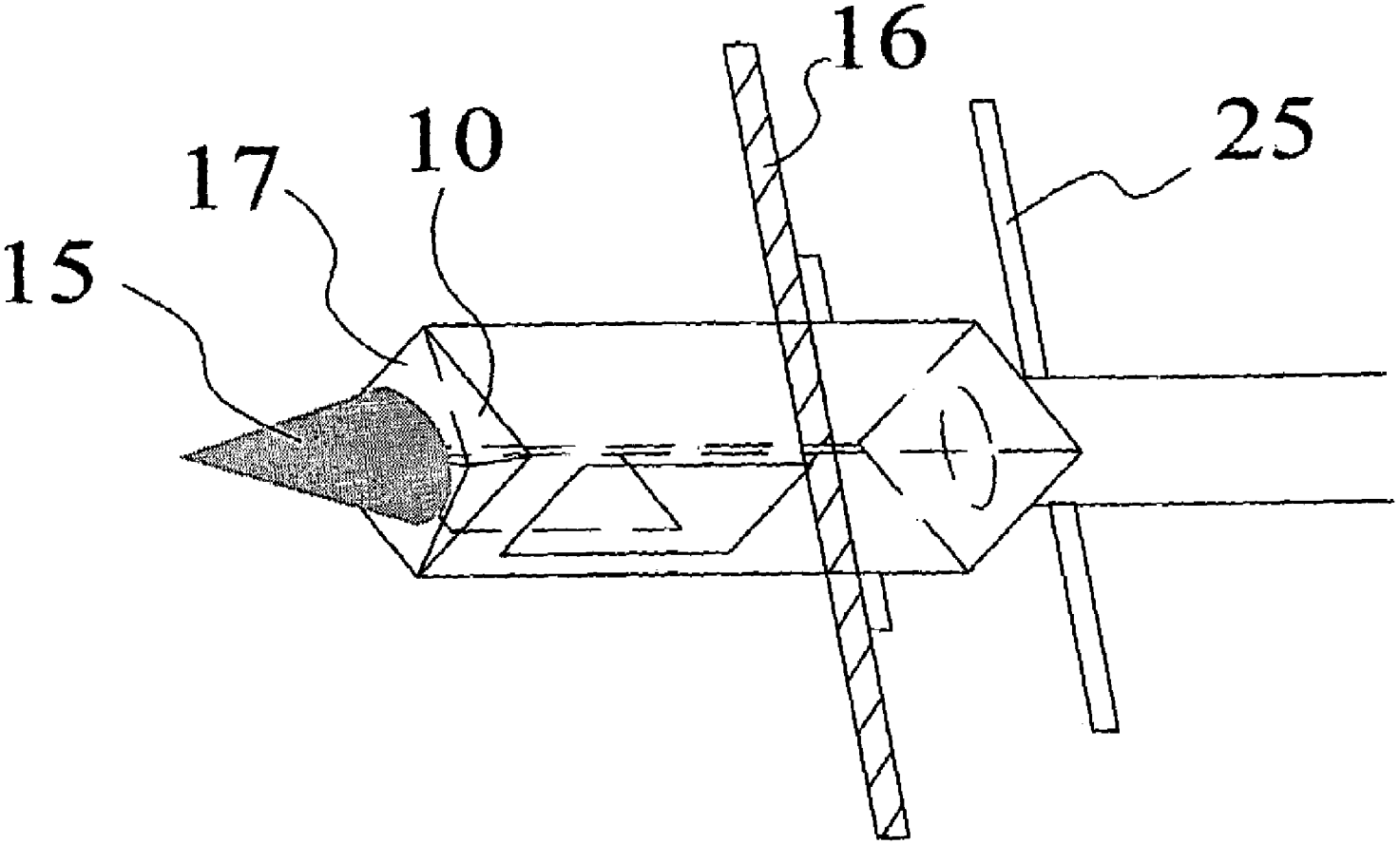
FIG. 9 shows dual exhaust ports and a battering ram formed by the end and the blade with opposing extensions (wall braces) and secured railings using a pyramid shaped projectile director and entry cone.

FIG. 9 shows dual exhaust ports and a battering ram formed by the end 17 and the pyramid shaped blade 15 with opposing pressure plates 25 and stops 16 using a pyramid shaped projectile director (ramp 10).

Figure 10:
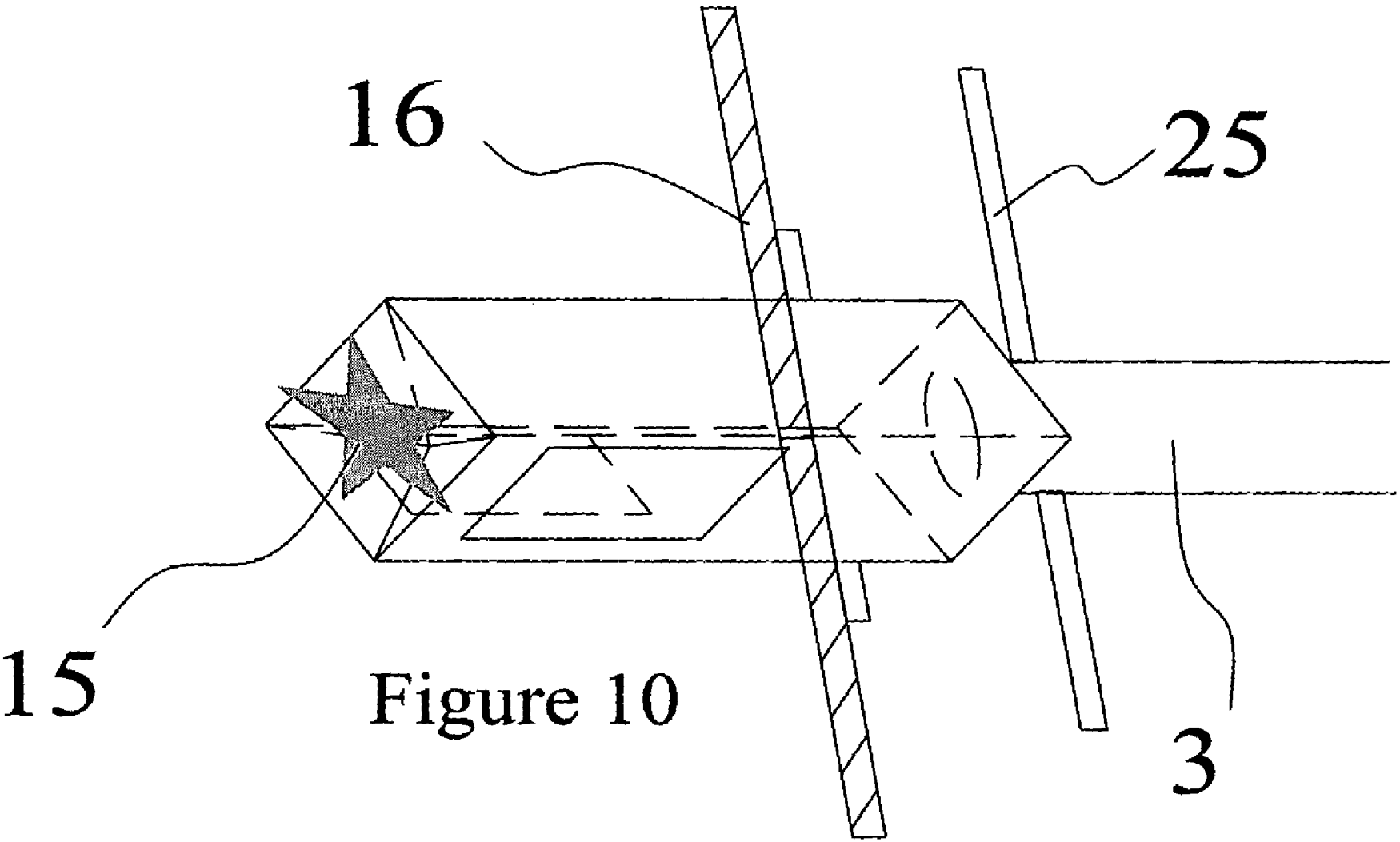
FIG. 10 shows dual exhaust ports and battering ram with opposing extensions (wall braces) and secured railings using a pyramid shaped projectile director ramp and an entry star shaped blade.

FIG. 10 shows dual exhaust ports and battering ram with opposing extensions (wall braces) and secured railings using a pyramid shaped projectile director and an entry star shaped blade 15. These blades may be interchangeable.

Figure 11:
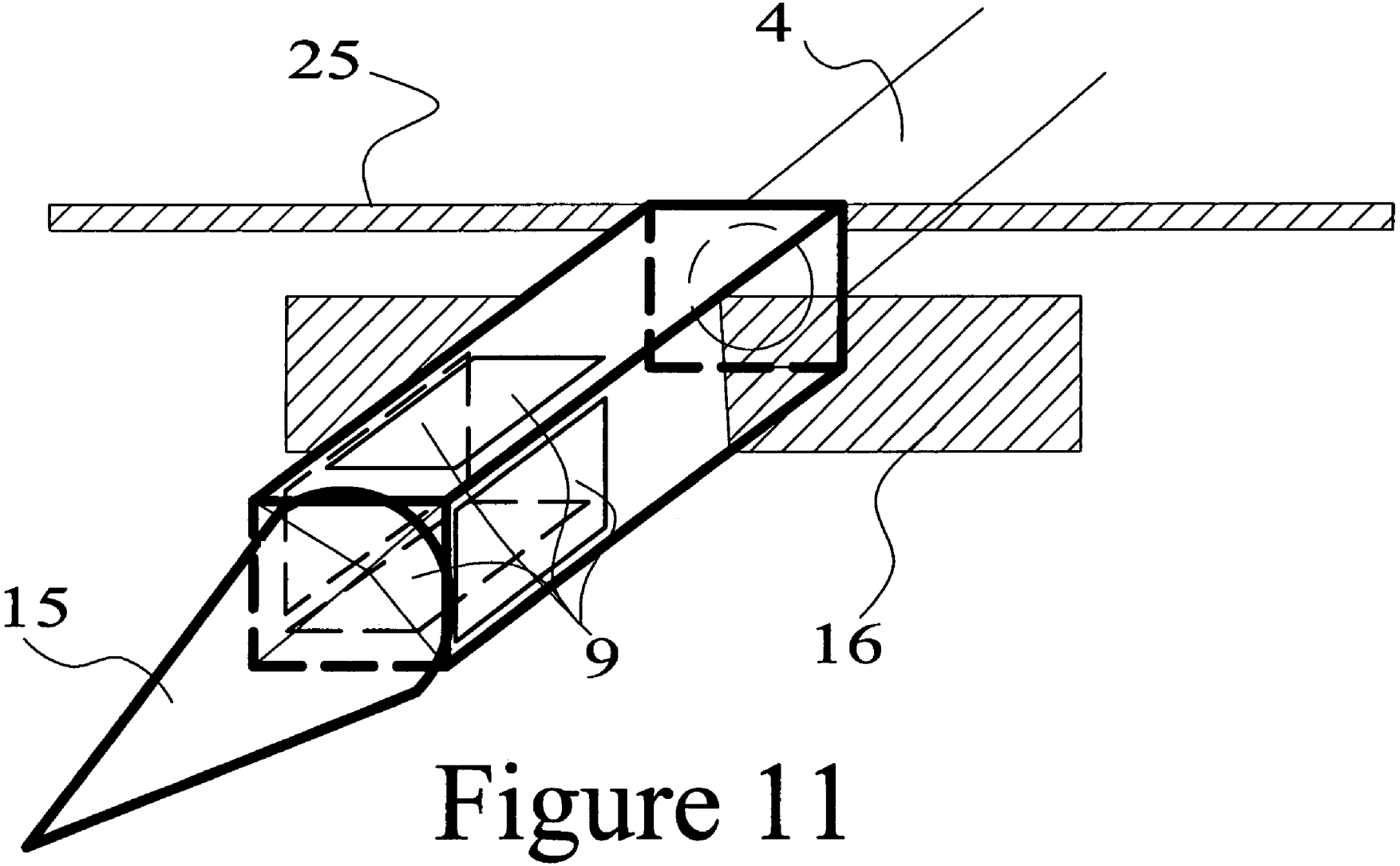
FIG. 11 shows four exhaust ports (exit openings) and battering rams with opposing extensions (wall braces) and secured railings using a pyramid projectile director ramp and entry cone.

FIG. 11 shows four exhaust ports 9 and a battering ram with opposing extensions (wall braces) and secured railings using an entry cone (blade 15).

In the embodiment shown in FIG. 11 there are openings in 4 directions except the front, the device may be held by one or more securing railings 11, for example, at the four corners as shown so that when the blast occurs, it goes out in four directions.

This would be useful when lethal or nonlethal gas shells, pellets 27 are utilized.

In such a case, the front and supporting posts would have to be of sufficient strength so that the blast would not knock them loose when the gun is discharged. The slanting walls described by the ramp 10 provide a surface which deflects the blast without absorbing the full impact of the blast for this purpose.

In the embodiment discussed previously, in addition, the supporting walls would have to be of sufficient strength so that as the device was pressed through the wall it would not bend on itself. The cone, blade 15, is larger than the extension to help keep the port 9 clear.

Figure 12:
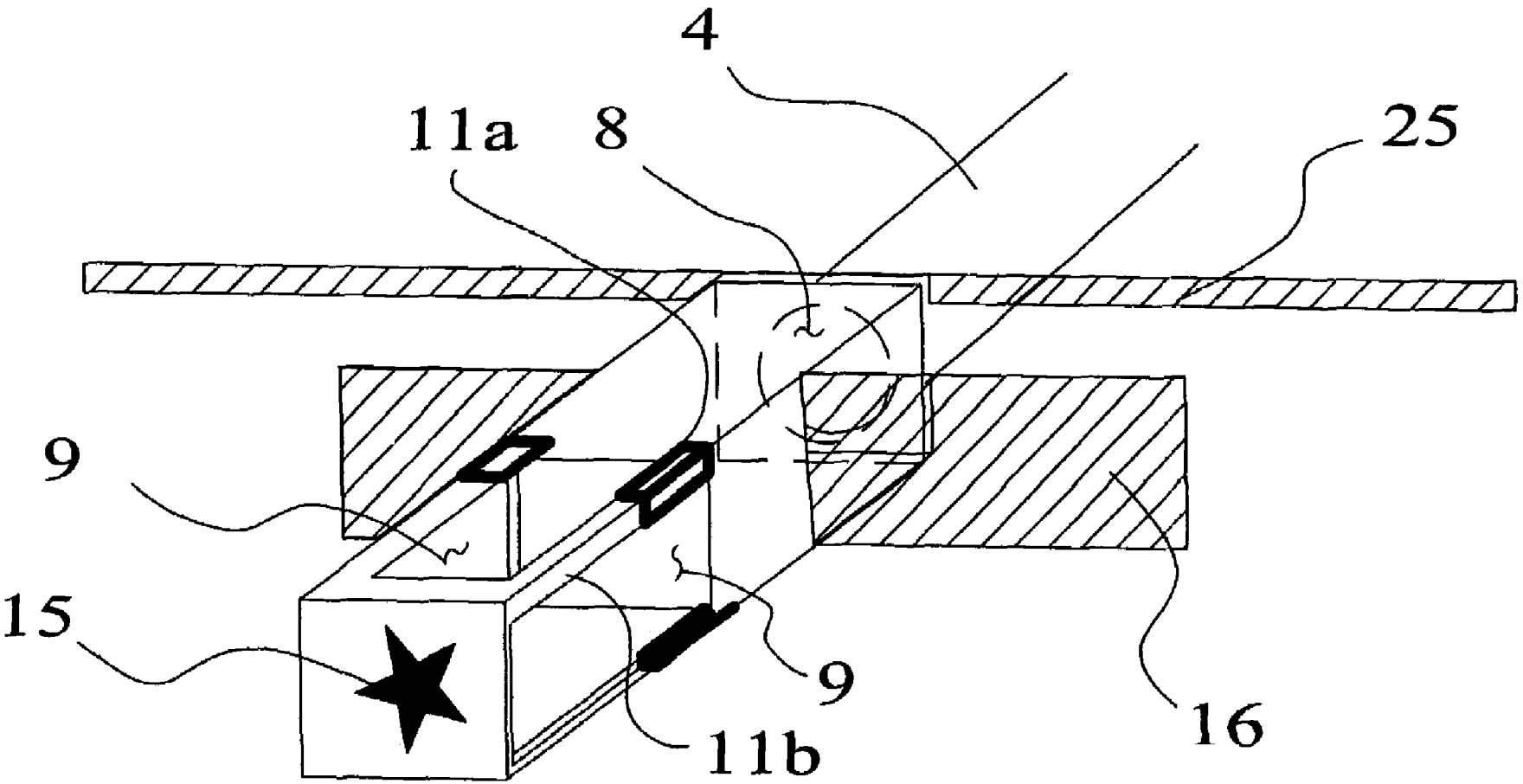
FIG. 12 shows four exhaust ports (exits) and an incorporated battering ram with opposing extensions (wall braces) and secured railings using a pyramid shaped projectile director ramp and entry star.
Figure 14:
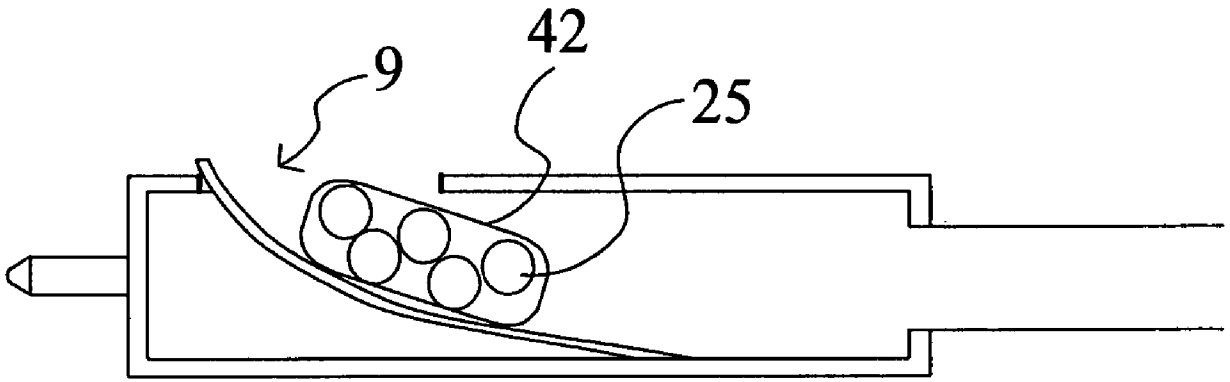
FIG. 14 shows the embodiment of FIG. 13 with a blast packet.

FIG. 12 shows four exhaust ports (exit) and battering ram with removable extensions (wall braces) and secured railings comprised of separating first railings 11*a* and insertable second railings 11*b* which fit removably within the first railings having a pyramid shaped projectile director (ramp) and entry star shaped blade 15.

Figure 13:
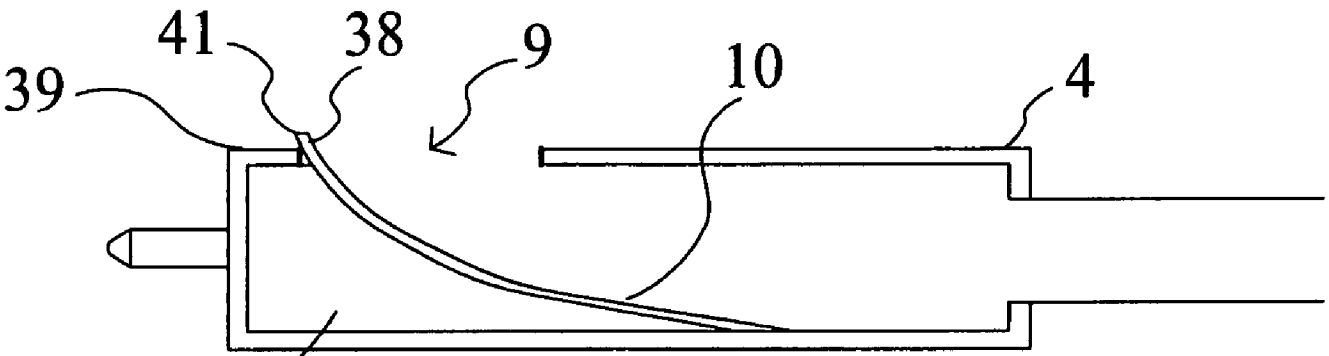
FIG. 13 shows an embodiment showing compressible filler elastic flexible material to absorb the movement of the ramp.

FIG. 13 (with pellets) shows how pellets 27 as a second auxiliary means which may contain a powder or a gas, such as pepper spray or the like of the type known in the art, may be held within a container 42 which container 42 is preferably a material such as paper or a thin breakable material which will shatter upon impact allowing for the loaded container 42 and pellets 27 to be expended through the opening 9 when the blast takes place.

The embodiment in FIG. 13 shows the use of barbs 37, which may prevent the device from being pushed back out of the wall after it has been inserted.

This also shows how the ramp 10 may have a ramp extension 38 which extends past the top 39 of the extension 4 and where there is a flexing filler 40 which is preferably elastic to allow some movement of the ramp 10 so that it can absorb the shock while the extension 38 ensures that the blast out of the opening 9 does not move to the front 41 of the extension 38 and also allows the ramp 10 to move downward without moving below the top 39 of the extension 4. FIG. 15 shows how the ramp extension 38 may slide against slide 50 provided for this purpose.

The location of the stop 16 may be adjustable as by mounting the stop 16 on a threaded barrel 35 or extension 4 so item can move along threads 36 on the extension 4 as shown in FIG. 15.

The device may include two or more barrel so that there is a first gun barrel and second gun barrel, both of which may be fitted with a sleeve 5 and extension 4 of the type previously described in order to allow multiple blasts to take place at once and in order to provide both an open barrel and a barrel covered by a sleeve and extension.

Figure 17:
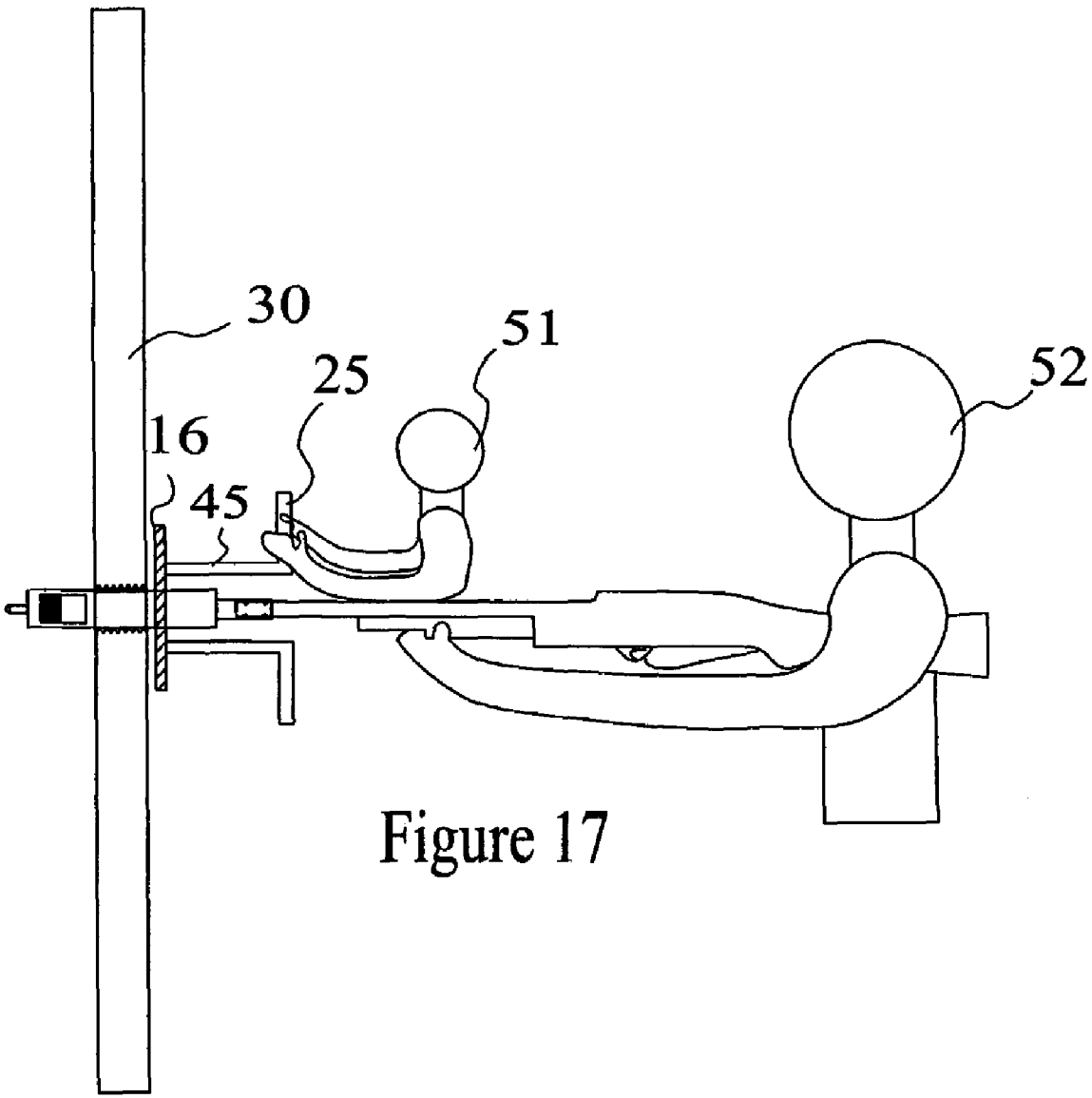
FIG. 17 shows an embodiment having a stop inserted through a wall by a first user and a second user.

FIG. 17 shows the device through a wall 30. FIG. 17 shows how the battering ram attached to the extension may be used to push the device through the wall by a second user 52 while a first user 51 controls the firing mechanism at the trigger 23.

The shape and size of the exhaust ports/exits may be varied to increase or enhance the sound from the blast by changing the sound in any manner such as a whistle, a louder noise, a milder noise, etc. While one vent barrel is shown in the preferred embodiment, multiple vent barrels, possibly coming off of one or more barrels would be possible in alternate embodiments to achieve the desired effect.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A noise generation device used in conjunction with an incendiary blast generating means for generating a blast said generating means having a barrel with a length and a direction of travel comprising:

a) at least one extension having a chamber continuous with the barrel for penetrating a structure for receiving the blast from the barrel with a first extension end and a second extension end opposite the first extension and at the point opposite the barrel;

b) a connecting means for joining the at least one chamber to the barrel;

c) and wherein the extension comprises at least one port defining an opening from the chamber having a first end near the barrel and a second end opposite the first end relative to the barrel;

d) a channeling means for directing the blast towards the at least one port and wherein the at least one port opens in a direction different than the barrel and wherein the extension comprises an extension fitting over the barrel and wherein the second extension end further comprises at least one blade extending opposite the barrel, said blade extending along the longitudinal center of the barrel and at least one ramp extending from the at least one port towards the chamber center towards the barrel and wherein the second extension end comprises a clearing means for preventing the obstruction of the at least one port when the end is pushed through the structure.

2. The invention of claim 1 wherein the clearing means comprises a blade extending beyond the port second end.

3. A noise generation device used in conjunction with an incendiary blast generating means for generating a blast said generating means having a barrel with a length and a direction of travel comprising:

a) at least one extension having a chamber continuous with the barrel for penetrating a structure for receiving the blast from the barrel with a first extension end and a second extension end opposite the first extension and at the point opposite the barrel;

b) a connecting means for joining the at least one chamber to the barrel;

c) and wherein the extension comprises at least one port defining an opening from the chamber having a first end near the barrel and a second end opposite the first end relative to the barrel;

d) a channeling means for directing the blast towards the at least one port and wherein the at least one port opens in a direction different than the barrel and wherein the extension comprises an extension fitting over the barrel and wherein the second extension end further comprises at least one blade extending opposite the barrel, said blade extending along the longitudinal center of the barrel and at least one ramp extending from the at least one port towards the chamber center towards the barrel and wherein the extension further comprises at least stop means between the barrel and the blade and wherein the stop means comprises a plate of greater diameter than the extension and wherein said plate is between the port first end and the barrel.

4. A noise generation device used in conjunction with an incendiary blast generating means for generating a blast said blast generating means having a barrel with a length and a direction of travel comprising:

a) at least one extension with a first extension end and a second extension end opposite the first extension and at the point opposite the barrel having a chamber continuous with the barrel;

b) a connecting means for joining the at least one chamber to the barrel;

c) and wherein the extension comprises at least one port defining an opening from the chamber having a first end near the barrel and a second end opposite the first end relative to the barrel said part being between the first extension end and second extension end;

d) a channeling means for directing the blast towards the at least one port and wherein the at least one port opens in a direction different than the barrel and wherein the extension comprises an extension fitting over the barrel and wherein the channeling means further comprises a ramp with a first end located against the barrel opposite the port and a second end extending to the port second end and wherein the device further comprises an auxiliary means for generating distraction from the at least one port from the group comprised of flash, sound, projectile gas, powder or combinations thereof in response to the blast generating means.

5. A noise generation device used in conjunction with a blast generating means for generating a blast said blast generating means having a barrel with a length and a direction of travel comprising:

a) at least one extension having a chamber continuous with the barrel;

b) a connecting means for joining the at least one chamber to the barrel;

c) and wherein the connecting means comprises at least one port defining an opening from the chamber having a first end near the barrel and a second end opposite the first end relative to the barrel;

d) a channeling means for directing the blast towards the port and wherein the blast generating means is a shot gun and wherein the device further comprises an auxiliary means for generating a distraction from the at least one port.

6. The device of claim 5 wherein the auxiliary means is insertable within the chamber.

* * * * *